United States Patent [19]

Ryhman et al.

[11] 4,088,529

[45] May 9, 1978

[54] METHOD OF RESIN SEASONING WOOD CHIPS

[75] Inventors: Jens Olov Ryhman; Nils Anton Vogt, both of Saffle, Sweden

[73] Assignee: Billeruds Aktiebolag, Billerud, Sweden

[21] Appl. No.: 631,309

[22] Filed: Nov. 12, 1975

[30] Foreign Application Priority Data

Dec. 10, 1974 Sweden ..... 7415430

[51] Int. Cl.[2] ..... D21C 1/08

[52] U.S. Cl. ..... 162/65; 195/8

[58] Field of Search ..... 162/65, 1, 100; 195/8

[56] References Cited

U.S. PATENT DOCUMENTS

| | | | |
|---|---|---|---|
| 1,850,808 | 3/1932 | Redd | 162/65 |
| 3,061,504 | 10/1962 | Mutton | 162/65 |
| 3,401,085 | 9/1968 | Croon et al. | 162/65 X |
| 3,668,063 | 6/1972 | Engstrom | 162/65 |
| 3,802,957 | 4/1974 | Cusi | 162/65 |
| 3,964,962 | 6/1976 | Carlsmith | 162/237 X |

FOREIGN PATENT DOCUMENTS

| | | | |
|---|---|---|---|
| 209,964 | 4/1968 | U.S.S.R. | 162/43 |

OTHER PUBLICATIONS

Rydholm; "Chip Pole Studies at Billeruds AB;" Pulp & Paper International; December 1963.

Annergren, et al. "On Outside Storage of Sprucewood Chips 145; for Sulphite Pulping," *Svensk Papperstidn* vol. 67, No. 4, Feb. 29, 1964.

Assarson et al., "Outside Chip Storage" *Svensk Papperstidn,* vol. 73, No. 16, pp. 493-501 (Aug. 31, 1970).

Assarsson et al., "Outside Chip Storage" *Svensk Papperstidn,* vol. 73, No. 17, pp. 528-541 (Sept. 15, 1970).

Dillner, "Outside Stored Chips As Raw Material For Pulping" FAO/NORAD Symposium; (Aug. 13-Sep. 8, 1972).

*Primary Examiner*—S. Leon Bashore
*Assistant Examiner*—Steve Alvo
*Attorney, Agent, or Firm*—Burns, Doane, Swecker & Mathis

[57] ABSTRACT

Air is circulated through a body of wood chips at a rate sufficient for maintaining a uniform temperature and oxygen content throughout the body of wood chips. Fresh air is supplied at a rate sufficient for keeping the oxygen content of the circulating air at 16% by volume, at least. The temperature is maintained at 35°-80° C. This process results in a rapid seasoning of the natural resin, of the wood chips, making it possible to use the wood chips for pulping after 1-4 days only.

7 Claims, 2 Drawing Figures

METHOD OF RESIN SEASONING WOOD CHIPS

The present invention relates to a method of processing wood chips. It is the main object of the invention to provide a method for producing a rapid seasoning of the natural resin in the wood chips. It is another object of the invention to provide a resin seasoning process which maintains a uniform moisture content in the entire body of wood chips being processed. It is a particular object of the invention to provide a method which makes the wood chips useful for a subsequent wood pulping process, particularly a sulphite pulping process.

Resin seasoning (which may also be referred to as resin ageing) means that the natural resin in the wood undergoes such alteration that it does not disturb the following manufacturing processes, and that an increased portion of the resin can be removed during digestion and bleaching. The alterations occur by biochemical oxidation and are accompanied by combustion of easily reacting substances in the wood, primarily hemicellulose and sugar. if the resin is allowed to season completely, which is generally considered desirable, almost 30% of the resin can be removed before the digestion. The substance loss of the wood is in that case 3 - 5%. The pulp loss is often negligible, however, since similar substances can also easily be dissolved during digestion and bleaching.

If cellulose pulp is to have the desired uniform qualities, the first requisite is a uniform chip quality, particularly for sulphite digestion. Previously the wood was stored in log piles for a year or so, after which it could be chopped to chips, which were immediately digested. Modern machinery for felling, transport and handling, as well as increased demands for rapid capital returns, have resulted in timber nowadays being chopped as quickly as possible into chips which are then blown into a stack where, due to the larger contact area of the chips with the air, the resin is seasoned considerably more quickly than previously. The seasoning as well as the moisture equalization will be especially rapid if the stack is made so large that the heat developed can be substantially retained in the stack. According to information available from various sources of literature, when the resin is fully seasoned about 20 $m^3$ normal volume (900 mol) carbon dioxide is developed per ton of dry wood which, at an optimal temperature of about 35° C, requires 40 days. Any shorter period of storage has been considered out of the question. After storing at 50° C for 72 hours, for instance, only about 0.8 $m^3$ (36 mol) carbon dioxide is produced, and the alterations in wood and resin have not been measurable. Added to this, in practice there are always a number of problems; extreme cold or the formation of ice may delay or prevent heating to the optimum storing temperature; the surface layer of the stack may be chilled and acquire different qualities; rot may set in. The storage must therefore be carefully watched, and since even tearing down the stack is troublesome, handling will require relatively hard work and high costs. The storage time is often 2 — 3 months, and interest costs are thus also still high.

According to the present invention, it has been found that the resin can be seasoned within a few days, thus eliminating the drawbacks mentioned above.

The method of the invention comprises providing a body of wood chips in a container which as seen from both FIGS. 1 and 2, of the drawings, is substantially closed to the atmosphere, maintaining a temperature of 35° - 80° C in said container, maintaining a circulation of air is said container to produce a uniform temperature and oxygen content in said container, withdrawing part of said circulating air, and substituting fresh air for said withdrawn air.

The invention will now be described with reference to FIGS. 1 and 2 and Tables 1, 2 and 3.

Table 1 shows the consumption and production of heat after 72 hours processing. Table 2 relates to digestion and bleaching experiments on a laboratory scale and records of the practical result of the invention. Table 3 shows that the invention operated on full production scale gives resin seasoning results at least as good as conventional storage of wood chips over long periods. The consumption of oxygen, air and heat is usually given per metric ton of dry wood. 1 mol gas = 22 liters at 0° C and 100 kPa (kilopascal). 1 $m^3$ air = approximately 1.3 kg.

Figure 1:
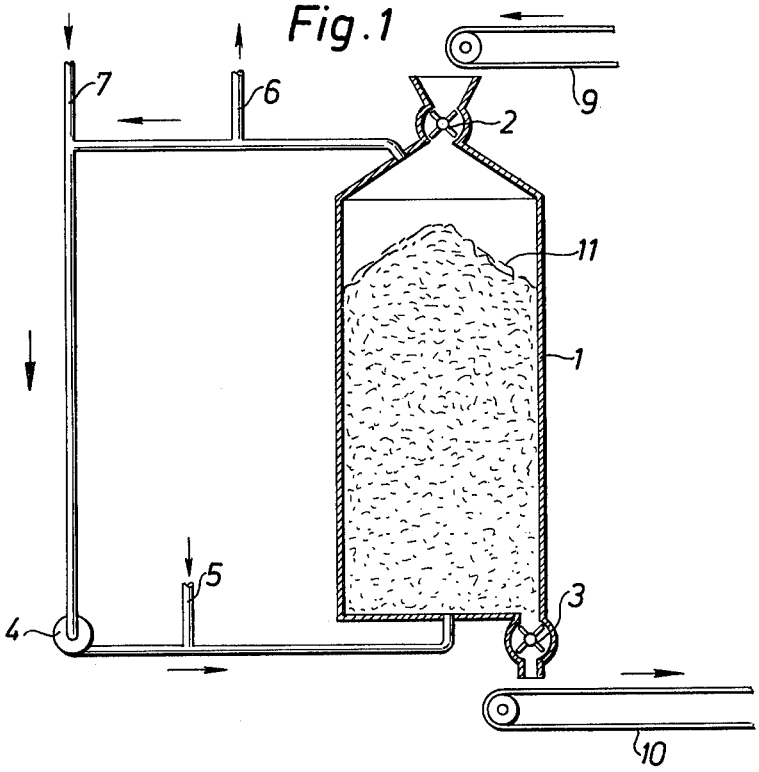
FIG. 1 shows a wood chips container for operating the method of the invention.

The container 1 of FIG. 1 is provided with a conveyor 9 and a rotary feeder 2 for supplying wood chips, and with means 3, 10 for removing chips. The wood chips move through the container in a substantially continuous flow. A fan 4 circulates air from the top to the bottom of the container. Heat is supplied by blowing steam through a pipe 5 into the circulating air. Alternatively, the circulating air may be heated indirectly via a heat-exchanger. Part of the air is blown out at an outlet 6. The same quantity of fresh air is supplied through an inlet 7. The quantities of air and heat at 5, 6 and 7 are regulated in known manner by valves, either manually or automatically. The wood chips are withdrawn from the container through a bottom outlet by means of a rotary feeder 3, and are transported to the pulping process on a conveyor 10.

Figure 2:
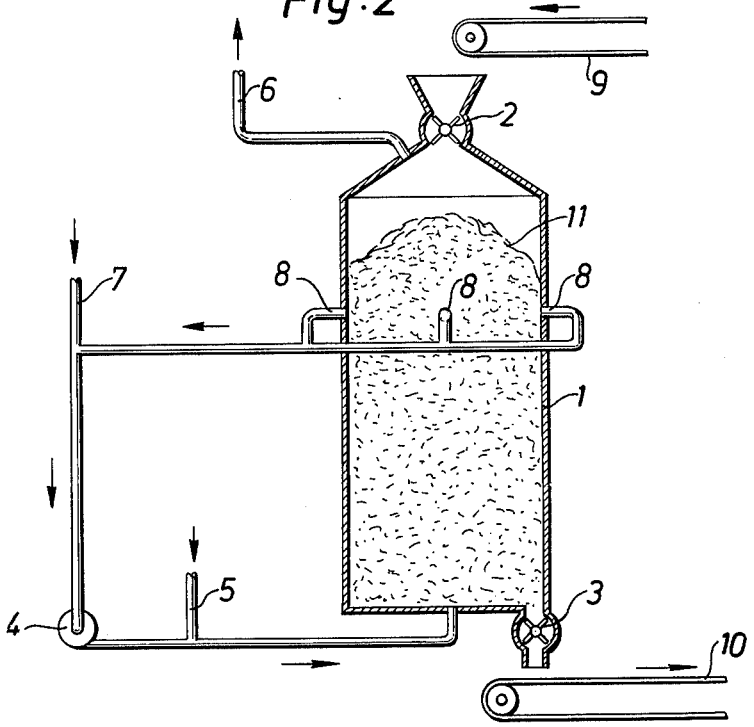
FIG. 2 shows another wood chips container.

FIG. 2 shows an example of how the equipment can be modified. In this case the recirculating air is drawn off some distance from the top of the container through outlets 8 placed around the container at the lowest level normally reached by the top surface 11 of the column of chips. The space above the outlets 8 serves as a buffer, whereas the space below the outlets 8 is normally filled with wood chips. The outlet 6 for consumed air is still at the top of the container, however, so that the air heat is recovered during the passage of the air through the cold chips above the outlets 8.

The equipment can of course be varied in many other ways. For example, the circulating air may be passed through the body of wood chips in a direction transverse to the flow of chips. The chips may be heated when or before they are fed into the container. Such heating, however, must be performed sufficiently slowly and without local overheating. The conditions necessary for heating will be described below.

Table 1 below specifies the consumption of heat, air, and oxygen for heating two metric tons of wood chips, having a water content of 50% by weight, from 0° to 50° C, and for processing said wood chips according to the invention for 72 hours. It is required that air shall be supplied to maintain an oxygen content of at least 16% by volume, and that the air shall be circulated at such a rate as to avoid any local over-heating in the body of wood chips. The heating of 1 metric ton of dry wood chips requires 1.25 $MJK^{-1}$ (megajoule per Kelvin). The heating of 1 metric ton of water requires 4.19 $MJK^{-1}$.

The heating of 1 kg air requires 1.0 $kJK^{-1}$ (kilojoule per Kelvin). The evaporation of 1 kg water requires 2400 kJ. The figures given in Table 1 do not include any loss of heat due to, for example, a poor heat insulation.

Table 1

| | | |
|---|---|---|
| Heating 1 metric ton dry wood chips | 62.5 MJ | (megajoule) |
| Heating 1 metric ton water in the chips | 210.0 MJ | |
| Heating 20×120 mol air (70 kg) | 3.5 MJ | |
| Evaporating water (6 kg) | 15.0 MJ | Gross 291 MJ |
| Heat produced by oxidation: | | |
| 60 mol $O_2$ to form $CO_2$ | 24.0 MJ | |
| 60 mol $O_2$ to form oxidation products other than $CO_2$ | 12.0 MJ | Deduct 36 MJ |
| | | Net 255 MJ |

According to laboratory experiments, 15 - 30 mol oxygen were consumed per metric ton of dry wood during the first 24 hours. If the oxygen content in the air falls to or below 16% there will be serious disturbance in the resin seasoning process, which cannot later be rectified. Allowing for a good margin of safety, therefore, it has been assumed that 120 mol oxygen per metric ton dry wood chips should be supplied during the specified 72-hour period, and only half of this quantity of oxygen, it is assumed, will be able to be completely converted to form $CO_2$, thereby producing 0.4 MJ heat per mol oxygens. The oxygen content may not be permitted to drop more than 5 units, i.e., from 21 to 16% by volume. The minimum air requirement for the supply of oxygen will thus be 120/0.05 = 2400 mol. or about 54 $m^3$ air per metric ton dry wood. The minimum air circulation for the heat supply will be 255/(15+3.5) = 14 times 2400 mol, i.e., 760 $m^3$ (0° C) per metric ton dry wood. The loosely packed chips take up a volume of about 7.5 $m^3$ per metric ton of dry chips. The air volume between the chips is approximately 5 $m^3$ per metric ton of dry chips. Said air, therefore, has to be changed approximately 150 times during a 72-hour period, or about twice an hour. It has been found that the temperature increase from 0° to 50° C takes place in a relatively narrow zone of the chips column. However, it is important to keep the position of said temperature increase zone under control. An easy way of doing this is to move the position of said zone up to the outlet for the circulating air by increasing the air velocity. In this case a regulator should be arranged to control the air circulation so that the temperature at outlet 8 in FIG. 2 is kept at 25° C, for instance, and another regulator should be arranged to control the steam supply so that the temperature of the air entering the container is kept at 50° C. The air circulation will then be approximately 1000 $m^3$ (0° C) per metric ton of dry wood. If the temperature in the container is increased the circulation can be substantially reduced, since the air will now transport a larger quantity of water vapour. At a temperature of 80° C the required air quantity is only 250–300 $m^3$ per metric ton of dry wood. In the embodiment according to FIG. 2 the air circulation rate must also be sufficient to ensure a uniform temperature. The risk of a local over-heating or under-heating increases with the temperature, and will primarily affect the region above the temperature-increasing zone. Said risk can be limited by lowering the temperature-increasing zone. Said risk can be limited by lowering the temperature and increasing or reversing the air circulation, as well as by making the container tall in relation to its bottom area.

Table 1 also shows that the heating of the chips, which of course should be performed without a heat-consuming drying of the chips, is only dependent to a slight degree on the air consumption and on the heat produced by oxidation. It is also evident that the heat produced by oxidation is sufficient to cover both the air heating and the normal heat losses to the surroundings. Admittedly in comparison with storage in stacks, there is an immediate increase in heat consumption of 255 MJ, corresponding to 0.1 metric ton steam per metric ton dry chips, or more at higher temperature. However, the heat added by this additional steam is completely utilized in the steaming of the chips prior to the digestion process. The total thermal economy is therefore considerably better than with outdoor storage of chips in stacks, where the loss of heat is considerable.

The technical results are clear from Table 2, showing a selection of results from laboratory experiments performed over processing periods of from 0 to 16 days at temperatures ranging from 50° to 80° C and with varying supplies of oxygen. The experiments showed that most of the resin seasoning is accomplished within 24 hours. Processing periods exceeding 4 days have not, therefore, been included in the table. Furthermore, the table only records results obtained at 60° C. Satisfactory resin seasoning was obtained at all temperatures, probably somewhat better at higher temperatures. However, 80° C was considered to be of less interest, partly because it was found that it might cause a risk of lignin condensation. Excessively high temperatures should also be avoided from the point of view of thermal economy, and about 60° C may therefore be preferable. The following applied in the experiments recorded in Table 2.

Seasoning: 0, 1, 2, and 4 days at a temperature of 60° C, with a full supply of air, and with a limited air supply. In the latter case the oxygen content had decreased to 15% after 2 days. Different wood samples were used for the two series.

Digesting: The processed wood was digested with a magnesium-based digestion liquor. The liquor had a content of combined $SO_2$ of 1.0%, and a total content of $SO_2$ of 6%. The ratio of wood to liquor was 1 to 4. The maximum temperature was 130° C. The time to reach the maximum temperature was 300 minutes. The maximum temperature was maintained for 210 - 270 minutes.

Bleaching: The pulp was bleached with chlorine, referred to as "C" in the table below, was subsequently subjected to an extraction with alkali, referred to as "E," and was finally bleached with hypochlorite, referred to as "H." The "charge" relates to the quantity of bleaching agent, in kilograms, per metric ton of dry pulp. The letter "K" represents the kappa number, because the quantity of added chlorine depended on the kappa number of the pulp. The quantity of alkali is given as the equivalent quantity of sodium hydroxide. The quantity of hypochlorite is given as the equivalent quantity of chlorine. The "excess alkali" means that alkali, defined as sodium hydrohydroxide, was added in a quantity amounting to 50% by weight of the bleaching agent, defined as chlorine.

| | C | E | H |
|---|---|---|---|
| Pulp concentration, % by weight | 3 | 10 | 10 |
| Temperature, ° C | 20 | 20 | 45 |
| Time, minutes | 60 | 120 | 240 |
| Charge | 2.4 K | 10 | 8 |
| Excess alkali, % | — | — | 50 |

Table 2

| | Wood processing with rapid resin Seasoning according to the invention | | | | | | | Wood stored for 1 year in log piles |
|---|---|---|---|---|---|---|---|---|
| | Limited oxygen supply | | | Full oxygen supply | | | | |
| Time at 60° C, days | 0 | 2 | 4 | 0 | 1 | 2 | 4 | |
| Solids content of wood, % | 54.1 | 55.3 | 53.9 | 45.8 | 44.8 | 44.4 | 43.0 | |
| Unbleached pulp: | | | | | | | | |
| Time at max. temp., minutes | 270 | 210 | 210 | 210 | 240 | 240 | 240 | |
| Kappa number | 13.9 | 28.1 | 35.7 | 11.8 | 15.4 | 15.9 | 22.8 | |
| DKM-extract, % | 1.18 | 0.75 | 0.86 | 0.89 | 0.68 | 0.67 | 0.75 | 1.10 |
| Bleached pulp: | | | | | | | | |
| Wood yield, % | 49.7 | 51.2 | 50.5 | 48.1 | 48.5 | 49.8 | 49.7 | |
| Brightness Scan,% | 88.2 | 84.9 | 83.7 | 88.8 | 87.5 | 88.1 | 88.8 | |
| DKM-extract, % | 1.09 | 0.75 | 0.75 | 1.09 | 0.72 | 0.67 | 0.60 | 0.88 |
| Extract-bound chlorine mg/kg | 2180 | 1480 | 1435 | 2240 | 1230 | 1190 | 1160 | 1640 |

The "DKM-extract" in Table 2 above relates to the quantity of resin dissolved when the pulp is extracted with dichloro-methane. The term "extract-bound chlorine" is used to define the quantity of resin which has been chlorinated during the bleaching process.

The limited oxygen supply was achieved by processing the wood in a closed vessel containing air. The oxygen content of the air dropped in two days from 21% to values between 16 and 11%. The oxygen consumption was 25 – 50 mol oxygen per metric ton dry chips. The air was subsequently replaced by fresh air. This method of substituting fresh air for the consumed air was not strictly in accordance with the invention because there was no circulation of air through the closed vessel. This inconsistency is not important, however, because the experiment was made with a small scale closed vessel, ensuring a uniform temperature, moisture content and oxygen content throughout the whole vessel. Therefore, it is clear from the results given in Table 2 that the damage caused to the resin seasoning during the first days is difficult to remedy later. On the other hand, it can be noted that in spite of this damage the processing result with a limited oxygen supply was acceptable. Thus already after about 1 day the resin content of the bleached pulp, which may be said to represent the result of the wood processing, had decreased to a level well below that obtainable with the use of conventionally stored wood, under comparable conditions during the pulping process. It is clear from Table 2 that it is preferred to supply air at such a rate that its oxygen content does not drop below 16% by volume during the processing of the wood chips.

An experiment was also performed on full production scale. The wood chips were processed at a temperature of 55° C in a container holding about 240 metric ton wood-chips and with a fan capacity of 20,000 $m^3/h$. Some of the heating was performed by adding steam to the circulating air, the rest by heating the circulating air in a heat exchanger. The processing time was planned to be 60 hours i.e., the chips flow was 4 metric tons per hour and the air circulation was 5000 $m^3$ per metric ton chips. This high rate of air circulation gave uniform heating. It was found, however, that the container used was not entirely suitable for this processing of wood chips, because the flow of chips was not entirely uniform. Therefore, the effective processing time was shorter than the desired 60 hours period. In spite of this unsatisfactory processing container the results obtained were very good, which is evident from Table 3 below.

Table 3

| Date of pulping | Type of wood used in pulping process | Unbleached pulp DKM-extract % | | Bleached pulp DKM-extract % | | Extract-bound chlorine mg/kg | |
|---|---|---|---|---|---|---|---|
| | | Batch | Average | Batch | Average | Batch | Average |
| 22 | Wood stored | 1.28 | | 1.04 | | 1750 | |
| 23 | for one year | 1.30 | | 0.92 | | 1500 | |
| 24 | in log piles | 1.24 | | 1.08 | | 1900 | |
| 25 | | 1.40 | | 1.20 | | 2200 | |
| 26 | | 1.34 | | 1.06 | | 1600 | |
| 27 | | 1.36 | | 0.96 | | 1400 | |
| 28 | | 1.32 | 1.32 | 1.06 | 1.05 | 1800 | 1750 |
| 29 | Wood processed | 1.34 | | 1.00 | | 1700 | |
| 30 | according to | 1.38 | | 1.12 | | 2000 | |
| 31 | the invention | 1.26 | | 1.06 | | 1600 | |
| 1 | | 1.30 | | 1.02 | | 1600 | |
| 2 | | 1.36 | 1.33 | 1.06 | 1.05 | 2000 | 1800 |
| 3 | Wood stored | 1.26 | | 1.06 | | 1900 | |
| 4 | for one year in log piles | 1.26 | 1.26 | 1.12 | 1.09 | 2100 | 2000 |

Table 3 discloses that, to serve as a comparison, pulping was made for seven consecutive days, to wit 22nd – 28th of the relevant month, using wood which had been stored for 1 year in log piles. Subsequently, the same pulping process was continued for 5 consecutive days, to wit from the 29th to the 2nd of the next month, using wood which had been processed for the 60 hours period referred to above. As a comparison, pulping was now continued during the 3rd and 4th using wood stored for 1 year in log piles. The various batches of pulp thus produced were analyzed. The results are given in Table 3. It is evident from Table 3 that the results obtained with the wood processed according to the invention are as good as those obtained with the wood which had been stored for 1 year. Consequently, the rapid resin seasoning process of the invention can replace the conventional long time storing of the wood before the pulping process.

What is claimed is:

1. A method of processing wood chips for producing a rapid resin seasoning, comprising providing a body of wood chips in a container which is substantially closed to the atmosphere, maintaining a temperature of 35° – 80° C in said container, maintaining a forced movement of air having an oxygen content of at least 16% by volume in said container to produce a biochemical oxidation at a uniform temperature and oxygen content in said container, withdrawing part of said moving air, substituting fresh air for a portion of said withdrawn air to form an oxygen enriched gaseous mixture, and reintroducing said oxygen enriched gaseous mixture into said container.

2. A method as claimed in claim 1, comprising adding wood chips to the top of the container, withdrawing wood chips from the bottom of the container, maintaining the forced movement of the air by withdrawing air from the top of the container, and reintroducing said oxygen enriched gaseous mixture to the bottom of the container.

3. A method as claimed in claim 1, comprising adding wood chips to the top of the container to produce a body of chips in the container, withdrawing wood chips from the bottom of the container, withdrawing part of the moving air from the container at a level intermediate the top and bottom of the body of the wood chips, reintroducing the oxygen enriched mixture thus obtained to the bottom of the container, and releasing the rest of the moving air from the top of the container.

4. A method as claimed in claim 1, comprising maintaining a temperature of 60° C in said container.

5. A method as claimed in claim 1, comprising maintaining the temperature in the container by heating the air entering the container.

6. A method as claimed in claim 5, comprising heating the air by adding steam to it.

7. A method as claimed in claim 1, comprising retaining the wood chips in said container for a time within the range from 15 to 100 hours.

* * * * *